US007676849B2

(12) United States Patent
Cho

(10) Patent No.: US 7,676,849 B2
(45) Date of Patent: Mar. 16, 2010

(54) FREE-SIZE HEADWEAR

(75) Inventor: Byoung-Woo Cho, Yongin (KR)

(73) Assignee: Yupoong, Inc., Seoul (KR)

( * ) Notice: Subject to any disclaimer, the term of this patent is extended or adjusted under 35 U.S.C. 154(b) by 245 days.

(21) Appl. No.: 10/763,224

(22) Filed: Jan. 26, 2004

(65) Prior Publication Data

US 2005/0160519 A1 Jul. 28, 2005

(51) Int. Cl.
*A42C 5/02* (2006.01)

(52) U.S. Cl. ..... 2/181; 2/209.4

(58) Field of Classification Search ..... 2/195.1, 2/171, 183, 181, 195.3, 209.12, 195.2, 181.4, 2/209.3, DIG. 11
See application file for complete search history.

(56) References Cited

U.S. PATENT DOCUMENTS 5,566,395 A * 10/1996 Nebeker ..... 2/181
6,131,202 A 10/2000 Yan
6,199,213 B1 * 3/2001 Whang ..... 2/181
6,347,410 B1 2/2002 Lee
6,920,644 B1 * 7/2005 Higgs ..... 2/195.3

FOREIGN PATENT DOCUMENTS

WO WO 01/05259 1/2001

OTHER PUBLICATIONS

Warner, Steven. Fiber Science, 1995. Prentice Hall, pp. 130-143.*
Australian Search Report for PCT/AU00/00847 dated Jul. 31, 2000.

* cited by examiner

*Primary Examiner*—Katherine Moran
*Assistant Examiner*—Richale L Quinn
(74) *Attorney, Agent, or Firm*—Staas & Halsey LLP

(57) ABSTRACT

Disclosed is a headwear which is mainly made of non-stretchable fiber. The headwear comprises a head receiving portion including a first stretchable fabric made of high twist yarn and a sweat band peripherally attached to the inside of the head receiving portion. Since the head receiving portion is mainly made of high twist yarn, the headwear has a fixed peripheral size but is adjustable within a predetermined range corresponding to small changes of head size. Also, the headwear can fit the head size to provide a comfortable sense of wearing.

12 Claims, 5 Drawing Sheets

200

- Prior Art-

200

FREE-SIZE HEADWEAR

BACKGROUND OF THE INVENTION

1. Field of the Invention

The present invention relates to a headwear, more particularly, relates to a headwear that fits a variety of head sizes and can slightly expand to fit different head sizes.

2. Description of the Prior Art

A baseball cap generally includes a crown, a visor and a sweat band. The crown receives a wearer's head and fixes the cap on the head. Accordingly, it is formed substantially in the shape of a hollow hemisphere. The crown, in general, is composed of panels or gores, which are successively stitched to form the crown. The visor is attached to the front portion of the lower edge of the crown, to protect the eyes from excessive sunlight. The sweat band is peripherally attached to the inside of the crown, along a lower edge thereof, such that it circumferentially contacts the head. The sweat band absorbs sweat to prevent it from running down onto the wearer's face, and presses the head to fix the cap on the head.

Because people have different sizes of head, size adjustable caps are preferred to fill this need. In order to meet this demand, several types of headwear have been designed, such as an adjustable cap, a free size cap and a sized cap.

FIG. 1 is a rear perspective view of a conventional adjustable cap.

Referring to FIG. 1, the conventional adjustable cap 10 includes a crown 20 and a visor 30. The crown 20 is composed of a plurality of gores, which are connected one by one to form the crown 20. The visor 30 is attached to the crown 10 at the front portion thereof. Additionally, a sweat band may be formed on the inside of the crown 20.

In order to fit a range of head sizes, the adjustable cap 10 includes a size adjustable part, which is composed of a rear opening, a strap 42 and a buckle 44. The rear opening is formed at the rear portion of the lower edge of the crown 20. The strap 42 is provided at one end of the rear opening and the buckle 44 is at the other end corresponding to the strap 42. By lengthening or shortening the length of the strap 42 and buckling it to the buckle 44, the peripheral size of the crown 10 can be adjusted depending on the head size of the wearer.

However, the adjustable cap 10 has a drawback in that some of the wearer's hairs coming out from the rear opening, and the lower edge of the crown could be partially wrinkled or crumpled. This drawback and the wrinkling affect the aesthetic appearance of the cap. Also, it requires a wearer to manually adjust the length of the strap 42 depending on his/her own head size.

Compared with the adjustable cap, a free size cap is capable of fitting a relatively broad range of head sizes without the use of a buckle and strap, so that it overcomes some of the above problems associated with the adjustable cap. Generally, in a free size cap, the crown and/or sweat band can be elastically stretchable in the direction of circumference so as to fit a broad range of head sizes. In this instance, the crown and/or the sweat band are composed of elastic material, for example spandex or polyurethane.

When the crown and/or the sweat band are stretched depending on the head sizes, they have the restoring force and press the head in return. The restoring force of the stretchable elastic fabric helps the cap to hold the head.

However, the more the crown is stretched, the bigger the pressing force applied to the head. Also, this pressing force is continuously applied to the head, when in use. So, the wearer could find it uncomfortable when he/she wears it, and it could leave an indent mark on the head after wearing for a long time.

Moreover, since the crown of a free size cap is made up of stretchable fabric, there is a problem that the crown can be wrinkled and cannot maintain its aesthetic shape when not in use.

Some prior arts are known concerning to the free size cap, as follows.

U.S. Pat. No. 6,131,202 to Yan relates to a multi-axially stretchable cap. According to the Yan patent, the gores of the cap are composed of multi-axially stretchable fabric, in which stretchable synthetic fiber are woven in both directions, as weft and wrap. Also, a sweat band includes a thin layer of synthetic foam material. Thus, the stretchable cap can stretch in weft and warp direction to provide an easy fit for the head. However, as the above described, the synthetic fabric can press the head with a large restoring force, when in use. Also, since the warp expands and contract in longitudinal direction and the weft in circumferential direction, the restoring forces by the weft and the warp are applied to the head independently. So, the restoring force by the weft is applied not associating with the warp, such that the wearer might still have an uncomfortable feeling while wearing the cap, in a manner similar to other free size caps. Further more, in case that the warp is elastically stretchable, the restoring force of the warp can draw the crown upward while wearing the cap, so to present the wearer an unpleasant feeling of wearing.

U.S. Pat. No. 6,347,410 to Lee relates to a self-sizing cap. The self-sizing cap of the Lee patent includes a crown portion, a visor and a sweat band. The crown portion is composed of triangle-shaped fabric panels and it can accommodate a range of head sizes comfortably. The sweat band is composed of two or more layers shaped into an elongated rectangle. The lower edge of the sweat band is flexibly attached to the lower peripheral edge of the crown portion, such that the sweat band can be stowed or deployed. When the sweat band is deployed, it can expand the attachment area on the wearer's head and provide more shade and warmth, and also it can have matching or contrasting color combinations.

PCT application No. WO01/05259 relates to a cap with a stretchable band. The cap includes a crown and an inner band, wherein the inner band is elastically stretchable along its direction of elongation and includes a liner for encircling the head comfortably. The crown is composed of gores and at least one of the gores is made of elastically stretchable material.

The abovementioned three patent references all are related to free size caps, which fit a relatively broad range of head sizes. The crowns of the free size caps continuously press the head and might provide the wearer with an uncomfortable feeling when in use. Moreover, the more the free size cap stretches, the more heavily the cap presses the head.

On the other hand, a sized cap is mainly made of non-stretchable material and has a fixed peripheral size. The sized cap generally includes a crown and a sweat band, which are mainly made of non-stretchable fiber. It does not have a rear opening for size adjustment, and does not elastically expand and contract. Thus, the crown of the sized cap is not wrinkled or crumpled, providing a good appearance.

The sized cap can best fit only one head size. However, it follows that many different sizes of caps should be fabricated for different head sizes. Also, depending on one's hairstyle and/or length, a sized cap could feel either too tight or loose, such that it could occasionally make the wearer feel uncomfortable.

SUMMARY OF THE INVENTION

It is an object of the present invention to provide a headwear that has a fixed peripheral size but is adjustable within a predetermined range corresponding to small changes of head size.

It is another object of the present invention to provide a headwear that fits the wearer comfortably.

To achieve the objects of the present invention, there is provided a headwear comprising a head receiving portion and a sweat band, wherein the head receiving portion includes first stretchable fabric mainly made of non-stretchable fiber, namely an improved sized cap.

The head receiving portion may be a crown or a head band. The crown is usually used to a cap or a hat for covering a head, and includes a plurality of panels. The panels are made of the first stretchable fabric and are stitched one by one to form the crown. While the headband may be used to a visor-type cap to peripherally receive the head.

The first stretchable fabric might be woven fabric, knitted fabric or non-woven fabric, wherein the fabrics are substantially made of non-stretchable fiber. Preferably, the first stretchable fabric includes high twist yarn. To fabricate high twist yarn, non-stretchable fibers are twisted over 800 times per meter in S or Z twist. Generally, the high twist yarns that are twisted about 1,000~3,000 times are widely used for commercial purposes. Though high twist yarn is made of non-stretchable fiber, it can slightly stretch due to its unique structural features. Accordingly, the crown composed of high twist yarn can fit the wearer's head, despite some changes in its peripheral size.

The sweat band is peripherally attached to the inside of the head receiving portion, more particularly, attached there along the lower edge of the head receiving portion. The sweat band absorbs sweat to prevent it from running down onto the face and slightly presses the circumference of the head to fix the headwear in place.

Preferably, the sweat band may include a band core and a second stretchable fabric. The band core, as a center portion of the sweat band, presses the head softly, and the second stretchable fabric partially receives the band core to cover it against the head. The band core includes soft material, for example polyurethane foam, other resin foam, woven fabric, knitted fabric, non-woven fabric, etc. The second stretchable fabric is composed of high twist yarn, allowing it to slightly expand and contract in a small range of peripheral size. Also, the second stretchable fabric could include elastic material as weft, such as spandex and polyurethane, so the sweat band can stretch more elastically than the head receiving portion. Thus the sweat band can fit the head in spite of some changes in head peripheral size, and can contact and press the head comfortably, neither too tightly nor loosely.

Additionally, a visor, a bill or a brim can be secured to the head receiving portion and extend outwardly. For example, in case that the headwear is a cap or an ivy cap, a visor might be formed at the front portion of a crown, and in case that the headwear is a hat, a brim might be formed along the lower edge of the crown, and still another headwear such as a visor-type cap might include a visor or a bill at the front portion of the headband. Namely, headwears of the present invention, such as a cap, a hat, an ivy cap, a visor-type cap, etc., can have a visor, a bill or a brim.

According to the present invention, the headwear has one head size and can slightly expand and contract to fit a head of the one head size, depending on some changes of hair style or length. Also, the headwear can fit heads of people who have almost the same but minutely different head sizes.

BRIEF DESCRIPTION OF THE DRAWINGS

The above objects and other advantages of the present invention will be more apparent by describing preferred embodiments thereof in detail with reference to accompanying drawings in which.

DETAILED DESCRIPTION OF THE PREFERRED EMBODIMENTS

Embodiment 1

Figure 1:
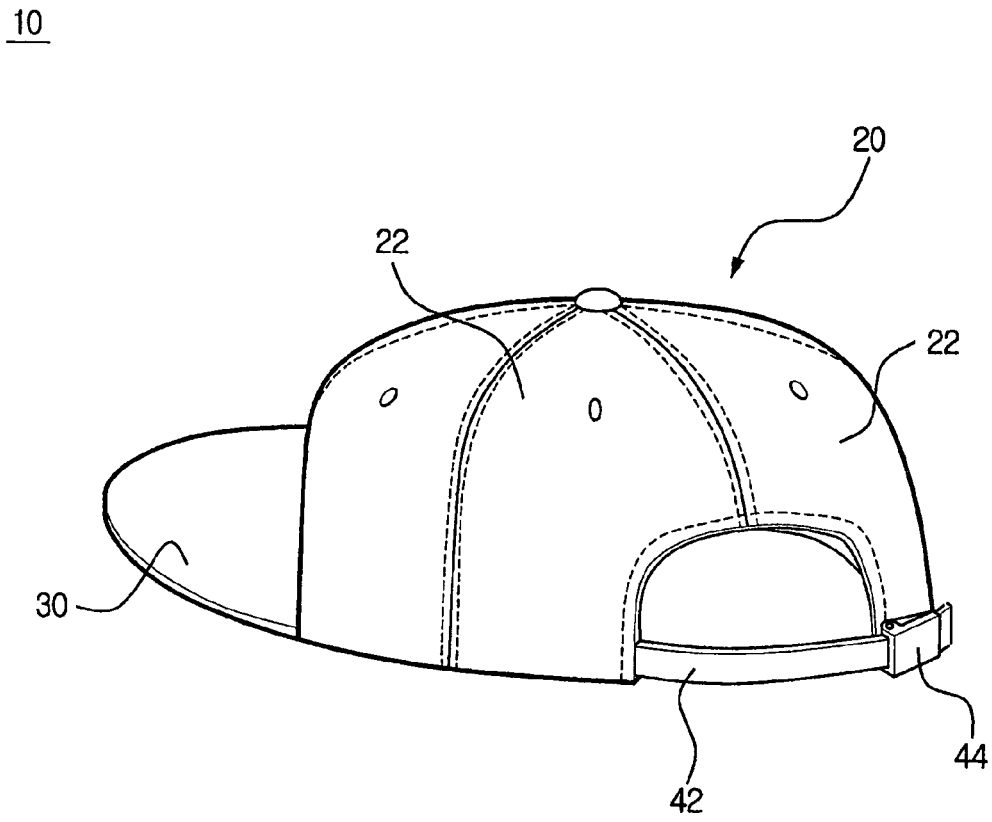
FIG. 1 is a rear perspective view of a conventional adjustable cap.
Figure 2:
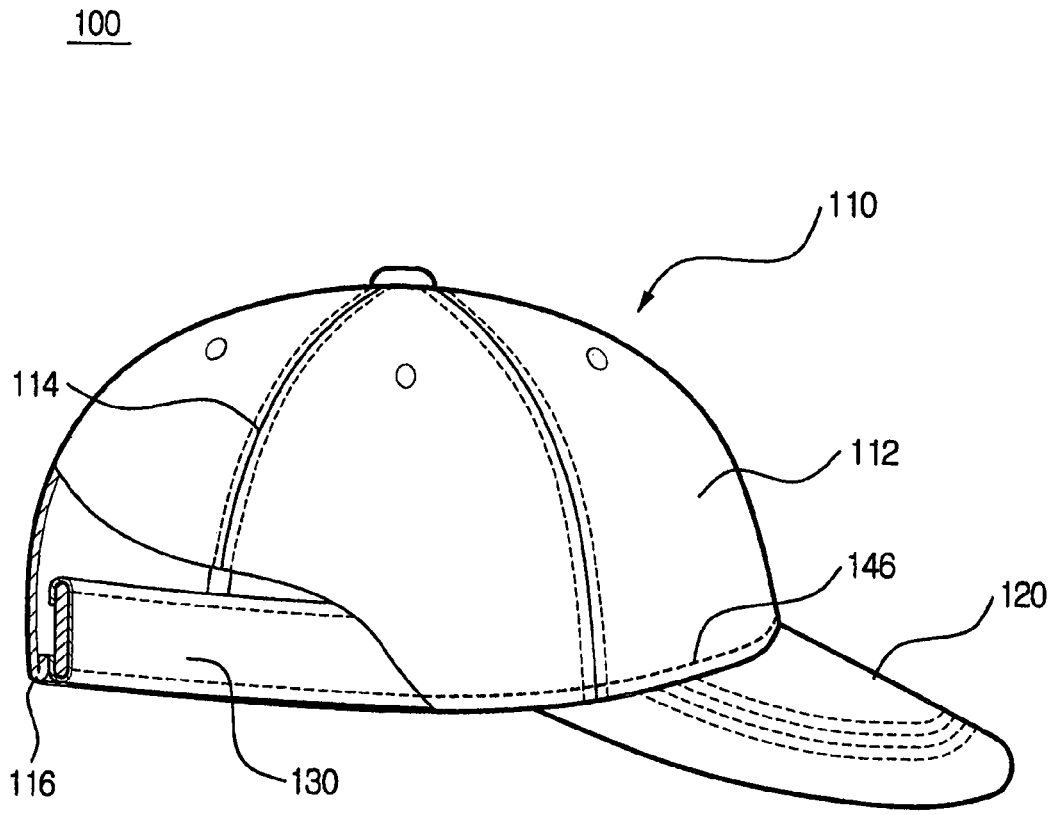
FIG. 2 is a partially cut view of a headwear according to a first embodiment of the present invention.
Figure 3:
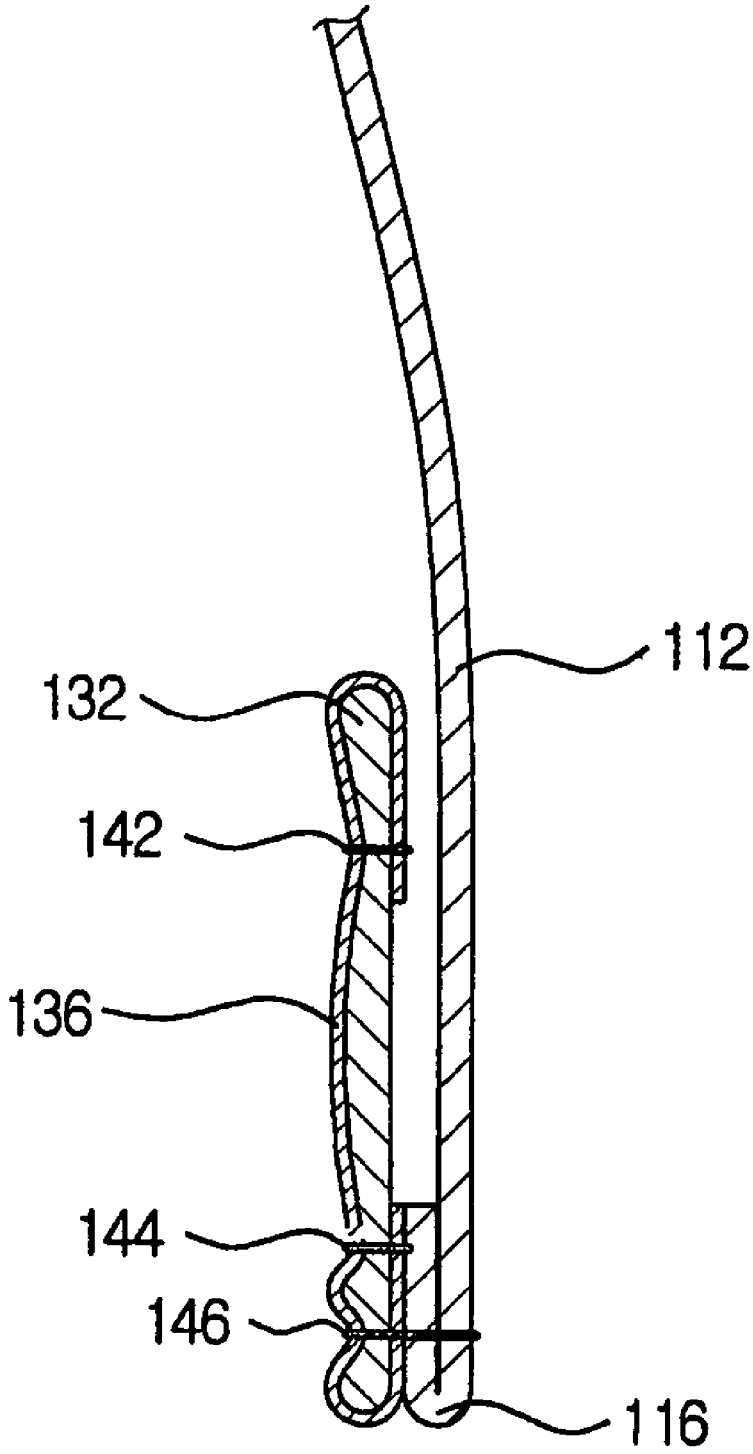
FIG. 3 is a sectional view of a sweat band of the headwear of FIG. 2.

FIG. 2 is a partially cut view of a headwear according to the embodiment 1 of the present invention, and FIG. 3 is a sectional view illustrating a sweat band of the headwear of FIG. 2.

Referring to FIG. 2 and FIG. 3, the headwear is a cap 100 for a baseball player or a kid, which includes a crown 110, a visor 120 and a sweat band 130.

The crown 110 is made up of plurality of gores 112. The gores 112 are successively stitched one by one, to form a hemisphere-shaped crown 110. Two of the gores 112 are stitched to form an inseam. A bias tape 114 is provided over the inseam between two adjacent gores on the inner side of the crown 110. Also, the bias tape 114 helps to prevent the gores 112 from being deformed.

Each of the gores 112 includes a first stretchable fabric mainly composed of high twist yarn. The high twist yarn generally is made of non-stretchable fibers that are twisted over 800 times per meter. The high twist yarn has slight expansion properties. Although the high twist yarn is made of non-stretchable fibers, it can expand and contract because of its high-twist structural feature. Here, the high twist yarn is included in the gore 112 as weft or warp, otherwise at least as weft, to help the crown 110 to expand circumferentially. Also, the gores 112 of this embodiment could be woven fabric, knitted fabric or non-woven fabric made of the high twist yarn.

The visor 120 has rigid nature and is secured to a front portion of the crown 110. It extends outwardly to protect a face or a neck from becoming sun burnt and eyes from sunlight.

The sweat band 130 is attached to the inside of the crown 110 along its lower edge to fix the cap 100 on the head. The sweat band 130 absorbs sweat to prevent it from running down onto the face. Particularly, the lower end portion of the crown 110 is inwardly bent, and the sweat band 130 is overlaid on. The lower edge of the crown 110 and the sweat band 130 are engaged with each other by the inwardly bent portion of the crown 110. The lower end portions of the sweat band 130 and the crown 110 are wholly pressed and stitched together to form a stitch line 146 that encircles the crown 110, parallel to its lower edge. The stitch line 146 is visible on the outer side of the crown 110 to provide an aesthetically pleasing appearance.

The sweat band 130 includes a band core 132 therein. The band core 132 is partially covered by a second stretchable fabric 136. The second stretchable fabric 136 is also mainly made of a high twist yarn described above or could include some elastic material like spandex, polyurethane, etc. When the second stretchable fabric includes elastic material, the second stretchable fabric 136 can stretch more elastically than the first stretchable fabric.

The band core 132 is composed of soft materials. This allows the sweat band 130 to wrap softly around the head, so to reduce pressing force and provide a comfortable fit. Also, the band core 132 helps to maintain the shape of the sweat band 130. The band core 132 can be made of polyurethane foam, other resin foam, woven fabric, knit fabric and non-woven fabric.

The second stretchable fabric 136 is disposed so that its weft direction is substantially parallel or somewhat inclined to the circumference of the sweat band 130. The second stretchable fabric 136 would be interposed between the band core 132 and the head, when in use, and partially covers upper and lower end portions of the band core 132, so to cover the inner face of the band core 132.

When the second stretchable fabric 136 is engaged with the band core 132, the upper and lower end portions of the sweat band 130 are stitched with a stretchable yarn 142 and 144.

Also, when the sweat band 130 is stitched to the crown 110, a stretchable yarn also is preferably used, so to form a stitch line 146. At this time, the lower end portions of the sweat band 130 and the crown 110 are wholly pressed and stitched together with the stretchable yarn, such that the stitch line 146 is visible on the outer side of the crown 110 and formed along the lower edge of the crown 110. Since the stretchable yarns for engaging the sweat band 130 and the crown 110 and for forming the stitch line 146 have stretchable properties, they can easily stretch corresponding to the expanding and contracting of the crown 110 and the sweat band 130. Thus, the stretchable yarns can regulate the appearance of the crown 110, and the stitch line 146, specially, can present the cap 100 with an aesthetically pleasing appearance.

When the wearer puts on the cap 100, the crown 110 and the sweat band 130 slightly expand so that it can accommodate a limited number of head sizes. As shown in FIG. 3, the lower end portion of the sweat band 130 is fixedly attached to the lower end portion of the crown 110, while the upper portion of the sweat band 130 is separated from the inner side of the crown 110. So, the upper portion of the sweat band 130 can move for a comfortable fit.

In sum, because the sweat band 130 and the crown 110 include high twist yarns according to embodiment 1, the cap 100 has an expanding property to a small degree. Therefore the cap 100 has smaller restoring force than the conventional free size cap, thus leaving no indented mark on the forehead. Additionally, the band core 132 made of a soft material makes the sweat band 130 wrap softly around the head, so to reduce the pressing force and provide a comfortable fit.

In embodiment 1, the cap 100 is described in detail as the headwear of the present invention. However, the headwear of the present invention might include a hat and ivy cap having a few panels, and a visor-type cap having a head band, etc., and the above descriptions can help to understand other styles of headwear.

Embodiment 2

Figure 4:
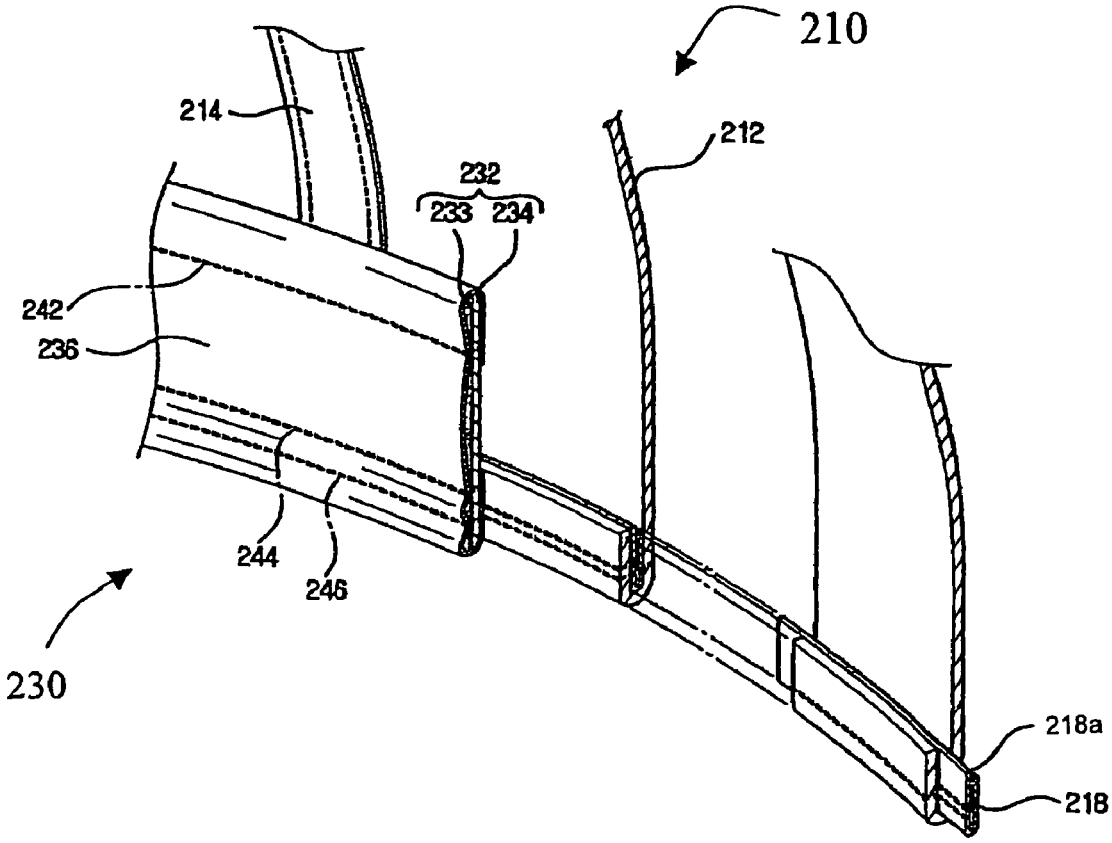
FIG. 4 is a partially cut view of a sweat band and a lower edge of a crown in a headwear according to a second embodiment of the present invention.
Figure 5:
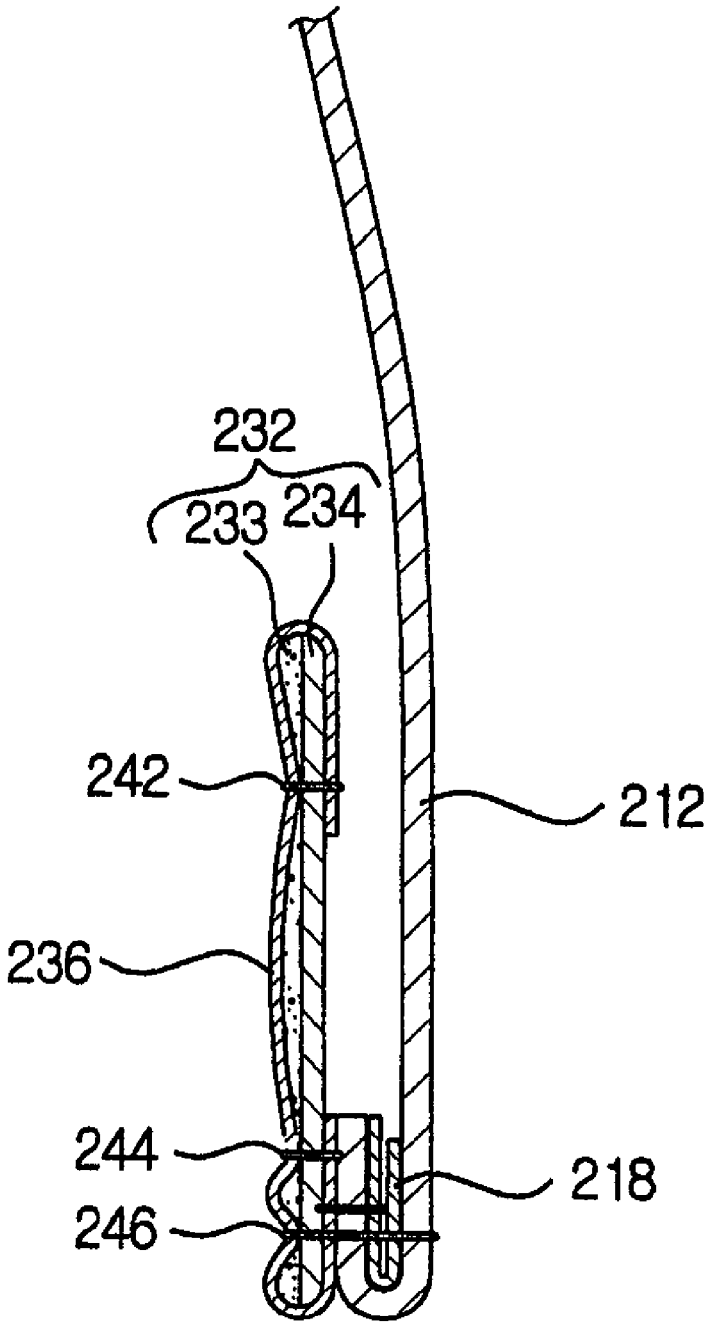
FIG. 5 is a sectional view of the sweat band of the headwear of FIG. 4.

FIG. 4 is a partially cut view illustrating a sweat band and a crown of a headwear according to embodiment 2 of the present invention, and FIG. 5 is a sectional view of the sweat band of the headwear.

In the embodiment 2, the headwear can be described with reference to the detail descriptions and drawings of the above embodiment, so that repeated descriptions and drawings may be omitted.

Referring to FIG. 4 and FIG. 5, the headwear is cap 200 for a baseball player or a child, and the cap 200 includes a crown 210, a visor and a sweat band 230.

The crown 210 is made up of plurality of gores 212. The gores 212 are successively stitched one by one, to form a hemisphere-shaped crown 210. Two of the gores 212 are stitched to form an inseam. A bias tape 214 is provided over the inseam between two adjacent gores on the inner side of the crown 210. Also, the bias tape 214 helps to prevent the gores 212 from being deformed.

Each of the gores 212 includes a first stretchable fabric mainly composed of high twist yarn. The high twist yarn generally is made of non-stretchable fibers that are twisted over 800 times per meter. The high twist yarn has slight expansion properties. Although the high twist yarn is made of non-stretchable fibers, it can expand and contract because of its high-twist structural feature. Here, the high twist yarn is included in the gore 212 as weft or warp, otherwise at least as weft, to help the crown 210 to expand circumferentially. Also, the gores 212 of this embodiment could be woven fabric, knitted fabric or non-woven fabric made of the high twist yarn.

The visor 220 has rigid nature and is secured to a front portion of the crown 210 in a manner similar to that of the visor 120 of the first embodiment. It extends outwardly to protect a face or a neck from becoming sun burnt and eyes from sunlight.

The sweat band 230 is attached to the inside of the crown 210, along its lower edge. The sweat band 230 can fix the cap 200 on the head and absorb sweat to prevent it from running down on the face. Particularly, the lower end portion of the crown 210 is partially folded to the inside and the sweat band 230 is overlaid on and stitched to the folded portion of the crown 210. The lower end portions of the sweat band 230 and the crown 210 are stitched together to form a stitch line 246 that encircles the crown 210 and is parallel to its lower edge. The stitch line 246 is visible on the outer side of the crown 210 to provide an aesthetically pleasing appearance.

The sweat band 230 includes a band core 232 therein, and the band core 232 is composed of a polyurethane form layer 233 inward and an elastic band layer 234 outward. The polyurethane form layer 233 is partially covered by a second stretchable fabric 236 to face the head. The second stretchable fabric 236 is mainly made of high twist yarn described above and could include some elastic material like spandex, polyurethane, etc. When the second stretchable fabric includes the elastic material, it can stretch more elastically than the first stretchable fabric.

The polyurethane foam layer 233 is formed inside of the band core 232 and is made of very soft material. So, it makes the sweat band 230 wrap the head softly around the head, so to reduce pressing force and provide a comfortable fit. Also, the polyurethane foam layer 233 helps to maintain the shape of the sweat band 230, when not in use. The elastic band layer 234 is formed outside of the band core 232 and is made of elastic material, so to provide a proper restoring force.

The second stretchable fabric 236 is disposed so that its weft direction is substantially parallel or somewhat inclined to the circumference of the sweat band 230. The second stretchable fabric 236 would be interposed between the band core 232 and the head, when in use, and partially covers upper and lower end portions of the band core 232, so to cover the inner face of the band core 232.

When the second stretchable fabric 236 is engaged with the band core 232, the upper and lower end portions of the sweat band 230 are stitched with a stretchable yarn 242 and 244.

Also, when the sweat band 230 is stitched to the crown 210, a stretchable yarn is preferably used, so to form a stitch line 246. At this time, the lower end portions of the sweat band 230 and the crown 210 are stitched together and the stitch line 246 is formed adjacent to and parallel to along the lower edge of the crown 210. Since the stitch line 246 is made of a stretchable yarn, they can stretch corresponding to the expanding and contracting of the crown 210 and the sweat band 230. The stitch 246 can regulate the appearance of the lower end portion of the crown 210 to present the cap 200 with an aesthetically pleasing appearance.

A shape tape 218 is attached circumferentially to the crown 210, adjacent to the lower edge thereof. The shape tape 218 is stitched along the folded portion of the crown 210. As the wearer puts on and takes off the cap repeatedly, the crown 210 also expands and contracts repeatedly, in which case the crown 210 is likely to become deformed and wrinkled. In order to prevent the cap from becoming deformed and/or wrinkled, the shape tape 218 is stitched circumferentially to the crown 210. As shown in FIG. 4, the shape tape 218 has a free upper portion 218*a* not attached to the crown 210 or the sweat band 230. Also, a top portion of the shape tape 218 does not contact the crown 210 or the sweat band 230.

Referring to FIG. 5, when the wearer puts on the cap, the crown 210 and the sweat band 230 slightly expand so that it can accommodate a limited number of head sizes. The lower end portion of the sweat band 230 is fixedly attached to the lower end portion of the crown 210, while the upper portion of the sweat band 230 is separated from the inner side of the crown 210. So, the upper portion of the sweat band 230 can additionally move for a comfortable fit.

Because the sweat band 230 and the crown 210 include high twist yarns, the cap can expand circumferentially to a small degree. Also, the cap according to the present invention has smaller restoring force than the conventional free size cap, thus leaving no indent mark on the wearer's forehead. Moreover, the sweat band 230 including the soft band core 232 wraps softly around the head, so to reduce the pressing force and provide a comfortable fit.

Although the preferred embodiments of the present invention have been described, it is understood that the present invention should not be limited to those preferred embodiments, but various changes and modifications can be made by one skilled in the art within the spirit and scope of the invention as hereinafter claimed.

What is claimed is:

1. A headwear comprising a head receiving portion including a first stretchable fabric made of high twist yarn, the high twist yarn being twisted over 800 times per meter;

a sweat band peripherally attached to the inside of the head receiving portion; and a shape tape attached to the head receiving portion along a lower edge of the head receiving portion, the shape tape having a free upper portion not attached to the head receiving portion or the sweat band, the shape tape including inner and outer surfaces that are in contact with the head receiving portion, wherein lower end portions of the head receiving portion and the sweat band are wholly pressed and stitched together with a stretchable yarn, along the lower edge of the crown, wherein the shape tape does not contact the sweatband.

2. The headwear as claimed in claim 1, wherein the head receiving portion is a crown of a hat or a cap for covering a head, the crown having panels of the first stretchable fabric, the panel being stitched to form the crown.

3. The headwear as claimed in claim 1, wherein the first stretchable fabric is one selected from a group comprising a woven fabric, knitted fabric and non-woven fabric.

4. The headwear as claimed in claim 1, wherein the first stretchable fabric includes the high twist yarn as weft.

5. The headwear as claimed in claim 1, wherein the sweat band includes a band core for softly pressing a head and a second stretchable fabric for partially covering the band core against the head.

6. The headwear as claimed in claim 5, wherein the second stretchable fabric includes high twist yarn.

7. The headwear as claimed in claim 6, wherein the second stretchable fabric includes an elastic material therein.

8. The headwear as claimed in claim 5, wherein the band core includes at least one selected from a group comprising woven fabric, knitted fabric, non-woven fabric and resin foam.

9. The headwear as claimed in claim 8, wherein the band core includes an elastic band layer and a polyurethane foam layer.

10. The headwear as claimed in claim 5, wherein the band core and the second stretchable fabric are stitched with a stretchable yarn.

11. The headwear as claimed in claim 1, wherein the head receiving portion is a separate element from the shape tape.

12. The headwear as claimed in claim 1, wherein the shape tape has a top portion that does not contact the head receiving portion or the sweat band.

* * * * *